United States Patent [19]

Brenner et al.

[11] Patent Number: 4,719,770

[45] Date of Patent: Jan. 19, 1988

[54] CLOTHES ROLLOVER AGITATION SYSTEM FOR AUTOMATIC WASHER

[75] Inventors: Robert A. Brenner, St. Joseph Township, Berrien County; William L. Kennedy, Coloma Township, Berrien County; Anthony Mason, Lincoln Township, Berrien County, all of Mich.

[73] Assignee: Whirlpool Corporation, Benton Harbor, Mich.

[21] Appl. No.: 897,302

[22] Filed: Aug. 18, 1986

[51] Int. Cl.[4] ..... D06F 17/10

[52] U.S. Cl. ..... 68/134

[58] Field of Search ..... 68/133, 134

[56] References Cited

U.S. PATENT DOCUMENTS

| | | | |
|---|---|---|---|
| Re. 18,928 | 8/1933 | Unruh | 68/133 |
| 1,629,391 | 5/1927 | Kemp et al. | 68/133 |
| 1,691,544 | 11/1928 | Dow | 68/133 X |
| 1,728,744 | 9/1929 | Block | 68/133 |
| 1,781,774 | 11/1930 | Block | 68/133 |
| 4,137,737 | 2/1979 | Robandt, II et al. | 68/134 |
| 4,357,812 | 11/1982 | Braga et al. | 68/18 D |
| 4,622,708 | 11/1986 | Gaelic | 68/134 X |

FOREIGN PATENT DOCUMENTS

| | | | |
|---|---|---|---|
| 183793 | 10/1984 | Japan | 68/134 |

*Primary Examiner*—Philip R. Coe

*Attorney, Agent, or Firm*—Hill, Van Santen, Steadman & Simpson

[57] ABSTRACT

A clothes rollover agitation system is provided for a vertical axis automatic washer in which the agitator has a skirt portion that has an inner portion which extends outwardly and downwardly and an outer portion which extends outwardly and upwardly to assist the clothes within the washer to undergo a 180° direction reversal in the bottom of the wash basket. The skirt portion stops short of the basket side wall and a removable ring member is secured to the basket wall to continue the upward and outward shape toward the sidewall. A plurality of buttons engagable in holes in the basket sidewall are used to secure the ring to the sidewall.

14 Claims, 6 Drawing Figures

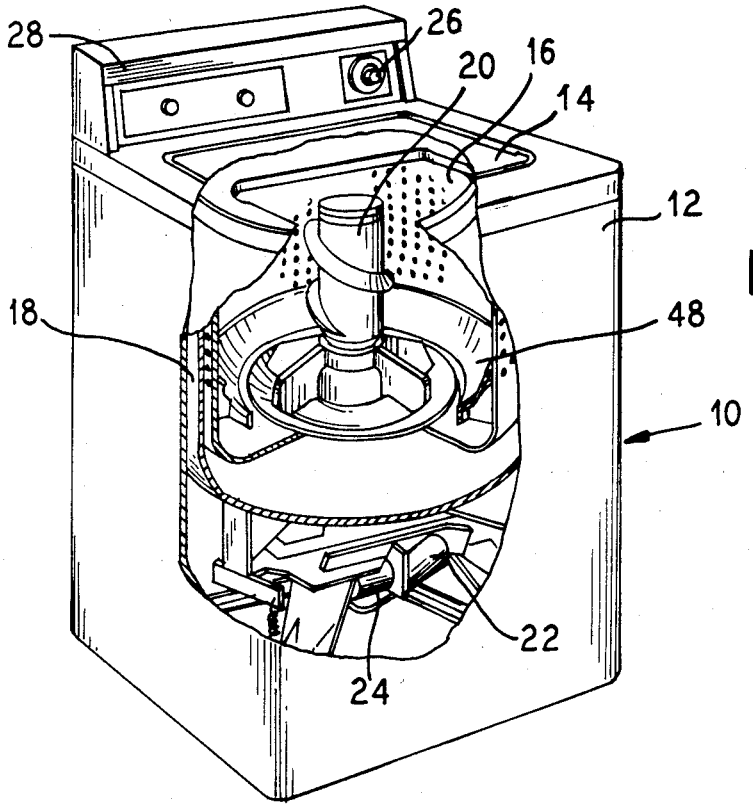
FIG. 1
FIG. 2
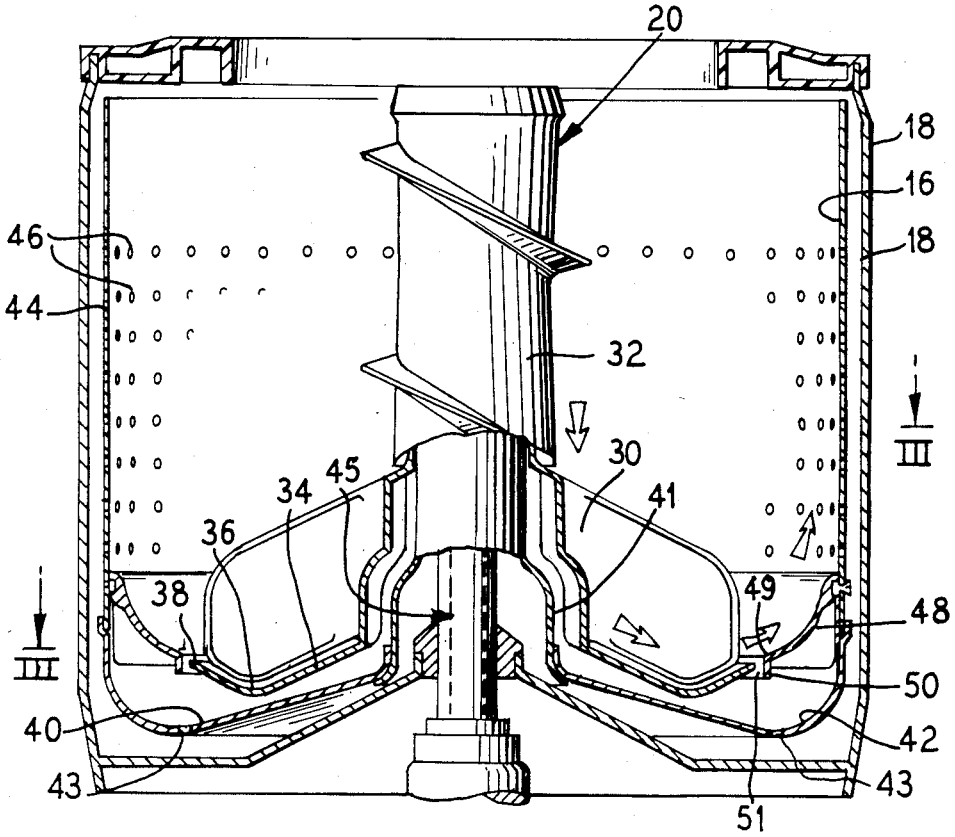

FIG. 3
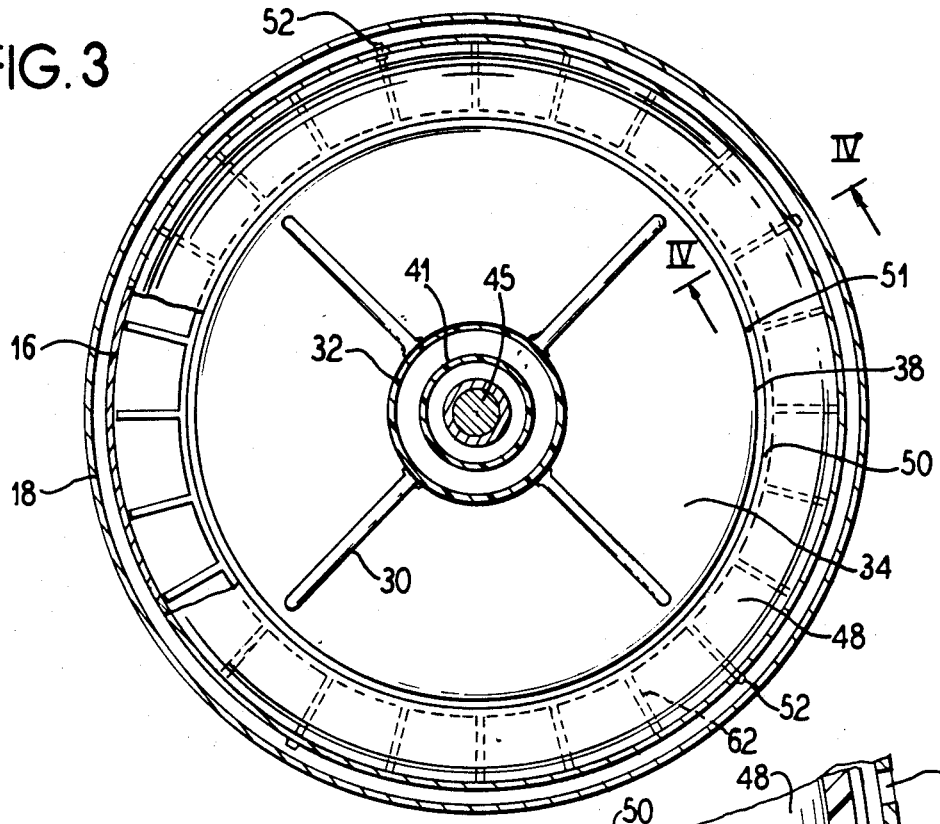
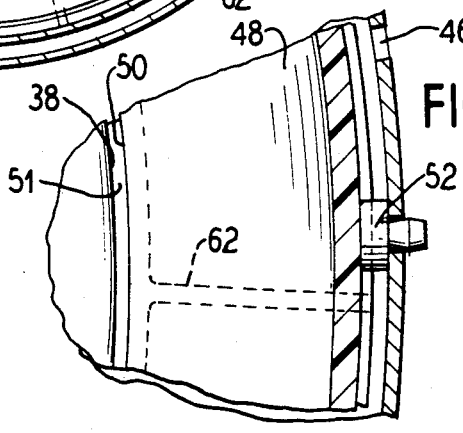
FIG. 5
FIG. 4
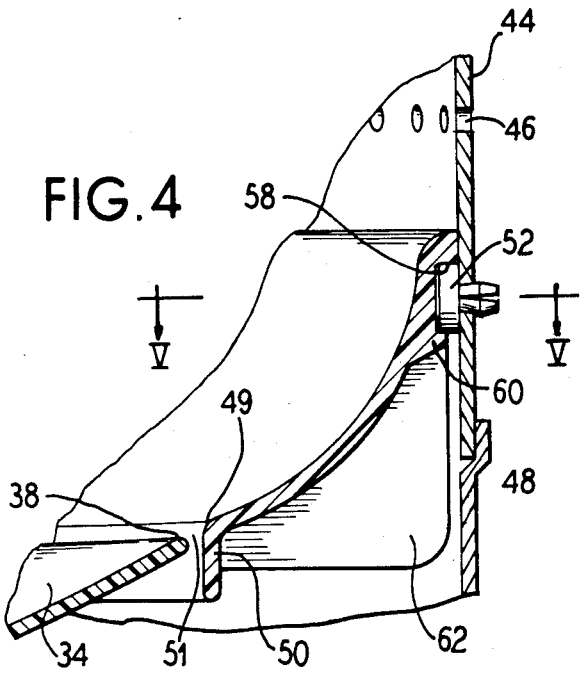
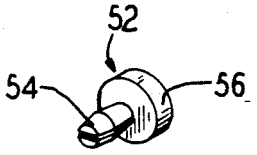
FIG. 6

CLOTHES ROLLOVER AGITATION SYSTEM FOR AUTOMATIC WASHER

BACKGROUND OF THE INVENTION

1. Field of the Invention

The present invention relates to automatic washers and more particularly to an improved rollover agitation system for use in a vertical axis automatic washer.

2. Description of the Prior Art

In vertical axis washers the agitator is generally provided with radial vanes near the bottom of the agitator which, when moved with the agitator in an oscillatory manner cause a toroidal movement of water within the wash basket to result in a turnover of the clothes load within the wash basket. It has been found that an increase in the turnover rate assists in improving the wash performance of the washer.

There have been a number of attempts to increase rollover rate within an automatic washer including forming the skirt portion of the agitator, which is the portion directly below the radially extending vanes, to deflect the clothes outwardly and upwardly to assist in the toroidal movement. U.S. Pat. No. 1,691,544 discloses a device having a vertical agitator with a plurality of radially extending flexible vanes and a skirt which extends away from the center post of the agitator in a downwardly and outwardly direction and then changes direction to an outwardly and upwardly direction toward the radial ends of the vanes. Thus, clothes coming in contact with the skirt would be directed outwardly and upwardly away from the vanes. The wash tub has a shape which complements the shape of the skirt in order to prevent clothes from flowing beneath the skirt.

U.S. Pat. No. 1,781,774 discloses a vertical agitator having a skirt portion that also has an upwardly and outwardly directed distal end which is received within a depression in the tub bottom wall such that the tub bottom wall is shaped somewhat complementarily to the skirt.

U.S. Pat. No. 1,728,744 also discloses a similarly shaped agitator skirt positioned within a wash tub which has a bottom wall configured to receive the agitator skirt. U.S. Pat. RE 18,928 discloses another vertical agitator with a skirt having an upwardly and outwardly extending distal end received within a depression in the washer tub bottom wall.

Since most vertical axis washers presently do not utilize an agitator skirt having an upwardly directed outer end, the wash tubs and baskets presently utilized are not formed specifically for such a configured skirt. Thus, in order to accomodate such a skirt, the prior art suggests that the bottom wall of the wash basket or wash tub be reconfigured to be shaped complementarily to the skirt. This, of course, would prevent such an agitator from being retrofitted into existing washers. Also, it would result in a major tooling and engineering cost to redesign wash tubs and wash baskets to accomodate an agitator skirt so configured.

SUMMARY OF THE INVENTION

The present invention provides a means for increasing the rollover rate within a vertical axis agitator by providing an agitator skirt in which the outer circumference of the skirt is directed upwardly to assist the clothes load in making the 180° change of direction from downwardly along the agitator shaft to upwardly along the wash basket wall. Further, the present invention provides a ring which can be secured to the basket wall to continue the upward and outward slope begun by the agitator skirt and to bridge the gap between the agitator skirt and the wash basket outer wall. The ring can be secured to the basket through a plurality of intermediate button type fasteners which snap into holes within the perforate wash basket. The buttons are received in a groove in the ring to hold the ring onto the basket.

The present invention allows for adaptation of the increased rollover agitator and skirt design to a standard wash basket without any changes to the basket. Thus, the agitator and ring can be retrofitted to a standard machine in the field as well as applied to newly manufactured machines.

The buttons which attach the ring to the basket are snapped into a row of basket holes already normally provided in the perforate wash basket. The buttons do not require equal spacing around the perimeter of the basket as the ring has no particular angular orientation requirement relative to the buttons. The ring is assembled easily by pushing it downwardly and snapping it into place over the buttons. Buttons are not required in every opening within the row around the perimeter of the basket, and in fact can be widely spaced, thus, the basket holes between the buttons allow for water flow beneath the ring since a space exists between the ring and the basket below the buttons.

Further, the agitator and ring are removable and can readily be reassembled into the proper position.

BRIEF DESCRIPTION OF THE DRAWINGS

FIG. 1 is a perspective view of an automatic washer partially cut away to show a clothes rollover agitation system embodying the principles of the present invention.

FIG. 2 is a side sectional view through the interior of the washer showing the agitator skirt and ring in cross section.

FIG. 3 is a top sectional view taken generally along the line III—III of FIG. 2.

FIG. 4 is a partial side sectional view of the ring taken generally along the line IV—IV of FIG. 3.

FIG. 5 is a top partial sectional view of the ring and button fastener taken generally along the line V—V of FIG. 4.

FIG. 6 is a perspective view of the button fastener.

DESCRIPTION OF THE PREFERRED EMBODIMENTS

In FIG. 1 there is shown generally an automatic washer 10 operable through a series of preprogrammed washing, rinsing and drying steps. The washer 10 has an outer cabinet 12 with a top openable lid 14 providing access to a perforate wash basket 16 carried within an imperforate wash tub 18. A vertical axis agitator 20 is mounted within the wash basket 16. The agitator 20 is driven by an electric motor 22 through an appropriate transmission 24 through a control mechanism (not shown) which can be selected by manipulation of a control dial 26 mounted on a console 28 of the washer.

The interior of the washer 10 is shown in greater detail in FIG. 2 where it is seen that the agitator 20 has a plurality of radially extending vanes 30 projecting outwardly from a central vertical post 32. Positioned below the vanes 30 is an agitator skirt 34 which extends first radially outwardly and downwardly away from the post 32 and then gradually changes direction at 36 to an outwardly and upwardly direction at a distal circumference 38.

The perforate wash basket 16 has a bottom wall 40 which extends radially downwardly and outwardly away from a central hub portion 41 beneath the post 32 of the agitator 20 and then gently curves upwardly at a bottom portion 42 near an outer circumference of the basket to merge with a vertical side wall 44 of the wash basket. The hub 41 is secured to the outer of two concentric drive shafts 45 which control the motion of the agitator and basket. The wash basket 16 is perforated by a series of rows of holes or openings 46 through the side wall 44 of the basket. This permits wash liquid to flow into the space between the perforate wash basket 16 and the imperforate wash tub 18.

Positioned between the outer circumference 28 of the agitator skirt 34 and the side wall 44 of the basket 16 is a ring 48 which continues the upward and outward shape of the outer portion of the agitator skirt. The ring 48 has an inner circumference 49 defined by a short vertical wall 50 just slightly larger than the outer circumference 38 of the agitator such that only a very small gap 51 exists between the agitator skirt and the ring. This small gap 51 prevents any clothes from becoming trapped beneath the agitator skirt during the wash cycle.

The short inner circumferential wall 50 provides a tolerance range for the positioning of the skirt outer edge 38 relative to the ring 48. At a maximum upward position of the skirt edge 38 relative to the ring 48, the skirt edge will be flush with the ring. All other positions of the skirt within the tolerance range will have the shirt edge terminating at a vertical position along the height of the inner ring wall 50. Thus clothes moving radially outwardly or radially inwardly accross the gap 51 between the skirt 34 and the ring 48 will not be able to pass beneath the ring or the skirt.

As seen in FIGS. 3–5, the ring 48 is secured to the side wall 44 of the wash basket 16 by a plurality of buttons 52 which can be spaced around the periphery of the basket wall 44. Applicants have found that five buttons spaced around the circumference of the basket wall is a sufficient number to retain the ring in place through a wash cycle, although more or fewer buttons could also be utilized.

The buttons, as seen in FIG. 6, comprise a split post portion 54 and a cylindrical head portion 56. The split post portion extends through the opening 46 in the basket wall, and the split nature of the post results in the button being securely held in the opening in that the material of the button is resilient and thus the split post resumes its original position after passing through the opening, locking the button to the wall 44. The cylindrical head portion 56 is received within a groove or channel 58 formed in the outer circumference of the ring 48. As the ring is slid downwardly within the wash basket toward the previously inserted buttons 52, the ring is snapped down onto the buttons such that they are captured within the channel 58 of the ring, thus securely holding the ring in place. To remove the ring, the inner circumferential wall 50 can be pulled upwardly thus disengaging a lip portion 60 below the channel 58 from the buttons, thereby detaching the ring from the buttons.

It has been found that the ring can be positioned such that the buttons 52 are placed in the lowermost row of openings 46 in the tub side wall 44 and, since the buttons 52 are angularly spaced apart, and are not required to be placed into every adjacent opening, there are unencumbered openings 46 in the bottom row which provide a communicating passage from outside of the wash basket into the space below the agitator skirt and ring. Also, an annular row of openings or holes 43 in the bottom portion 42 of the basket allows liquid to drain from the basket. Thus, lint and dirt do not collect in the area below the ring.

A plurality of strengthening ribs 62 are provided on the underside of the ring 48 to ensure that the shape of the ring will be maintained so that the gap 51 is never enlarged which could result in clothes being trapped beneath the skirt 38.

By providing a separate ring and the specially configured agitator skirt which initiates a change in the clothes direction from downwardly to upwardly, the system of the present invention can be incorporated into existing washers already placed in service as well as in newly manufactured washers. Further, the greater expense of retooling to produce a wash basket having a bottom wall designed to compliment the shape of the agitator skirt is avoided and only the lesser cost of tooling for the ring is required. Further still, should some foreign object manage to become trapped between the agitator and ring, or underneath the ring, the ring is easily removed to retrieve the object.

As is apparent from the foregoing specification, the invention is susceptible of being embodied with various As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A clothes rollover agitation system for an automatic washer having a vertical axis agitator with a plurality of radially extending vanes adjacent a lower end of said agitator extending outwardly from a central agitator post mounted centrally within a cylindrical wash basket having a bottom wall and a substantially vertical side wall, comprising:

a skirt portion formed on said agitator below said vanes having an inner portion extending radially outwardly and downwardly away from said post and an outer portion extending radially outwardly and upwardly to a distal perimeter terminating a distance from said wash basket side wall; and a ring member secured to the interior of said wash basket between said distal perimeter of said agitator skirt and said basket side wall, said ring member having a cross-sectional profile shaped to continue the upward and outward shape of said outer portion of said agitator skirt;

whereby, the shape of said agitator skirt will assist in increasing the rollover rate of clothes within said wash basket, and said ring member will provide a smooth transition path between said agitator skirt and said basket side wall.

2. A clothes rollover agitation system according to claim 1 wherein said basket side wall is perforated by a plurality of holes and said ring member is secured to said side wall through at least some of said holes.

3. A clothes rollover agitation system according to claim 2 including a plurality of button members engagable into said basket wall holes which are in turn engagable by said ring member to provide said securement between said ring member and said basket.

4. A clothes rollover agitation system according to claim 3 wherein said ring member has a channel formed in an outer peripheral wall sized to receive said buttons.

5. A clothes rollover agitation system according to claim 1 wherein said ring member is selectively removable from said basket side wall.

6. A clothes rollover agitation system according to claim 1 wherein said ring member has an inner peripheral edge slightly larger than said distal perimeter of said agitator skirt whereby only a small gap exists between said skirt and said ring member.

7. A clothes rollover agitation system for an automatic washer having a vertical axis agitator with a central agitator post mounted within a cylindrical wash basket having a bottom wall and a substantially vertical side wall comprising:

a skirt portion formed on a lower end of said agitator post first extending downwardly and outwardly from said post and then extending upwardly and outwardly at a distal circumference to change the direction of clothes moving within said wash basket from downwardly along said agitator post to upwardly along said basket side wall, said distal circumference being spaced away from said basket side wall; and a ring member attached to said basket side wall to extend between said distal circumference of said skirt and said basket side wall, said ring member being shaped to continue the upward and outward shape of the distal portion of said agitator skirt to assist in directing said clothes upwardly toward said basket side wall.

8. A clothes rollover agitation system for an automatic washer having a vertical axis agitator with a central agitator post mounted within a cylindrical wash basket having a bottom wall and a substantially vertical side wall comprising:

a skirt portion formed on said agitator shaped to change the direction of clothes moving within said wash basket from downwardly along said agitator post to upwardly along said basket side wall, said skirt portion having an outer peripheral edge spaced away from said basket side wall;

a ring member attachable to said basket side wall to extend between said outer peripheral skirt edge and said basket wall, said ring member being shaped to assist in direction said clothes upwardly toward said basket side wall; and said basket side wall having a plurality of rows of openings therethrough for passage of wash liquid and said ring member being attachable to said basket through some of said openings.

9. A clothes rollover agitation system according to claim 8 including a plurality of snap fasteners engagable into said openings in said basket side wall to provide said attachment between said ring member and said basket.

10. A clothes rollover agitation system according to claim 9 wherein said ring member has a groove formed in an outer peripheral wall in which said snap fasteners are received.

11. A clothes rollover agitation system according to claim 7 wherein said ring member is selectively detachable from said basket side wall.

12. A clothes rollover agitation system according to claim 7 wherein said ring member has an inner peripheral edge slightly larger in diameter than said distal circumference of said skirt for increasing the rollover rate of clothes within said basket.

13. A clothes rollover agitation system for an automatic washer having a vertical axis agitator with a plurality of radially extending vanes adjacent a lower end of said agitator extending outwardly from a central agitator post mounted centrally with a cylindrical wash basket having a bottom wall and a substantially vertical perforate side wall for containing a clothes load, comprising:

a skirt portion formed on said agitator below said vanes having an inner portion extending radially outwardly and downwardly from said post and an outer portion extending outwardly and upwardly to a distal perimeter terminating a distance from said wash basket side wall;

a plurality of button members engagable into holes in said perforate basket side wall;

a ring member having an inner peripheral wall slightly larger in diameter than said distal perimeter of said skirt portion and an outer peripheral wall substantially equal in diameter to a inner surface of said basket side wall with a channel formed in said outer peripheral wall to receive said button members;

said ring member having a cross-sectional profile shaped to continue the upward and outward shape of said outer portion of said agitator skirt;

whereby said ring member is securable between said basket wall and said skirt portion to assist the skirt portion in increasing the rollover rate of clothes within said basket.

14. A clothes rollover agitation system according to claim 13 wherein said inner peripheral wall of said ring member has a short vertical extent such that said distal perimeter of said skirt portion can be vertically positioned relative to said ring member throughout a range corresponding to the vertical height of said inner peripheral wall of said ring member while still preventing clothes within said wash basket from passing beneath said ring or said skirt.

* * * * *